United States Patent [19]

Suter

[11] Patent Number: 4,533,130

[45] Date of Patent: Aug. 6, 1985

[54] APPARATUS FOR FOLDING A RUNNING WEB WITH FOLDING ROLLER AND ADJUSTABLE PARALLELLING BAR

[76] Inventor: Walter Suter, Ringlikerstrasse 39, CH-8142 Uitikon, Switzerland

[21] Appl. No.: 653,856

[22] Filed: Sep. 24, 1984

[30] Foreign Application Priority Data

Sep. 28, 1983 [CH] Switzerland ..... 5264/83

[51] Int. Cl.[3] ..... B41L 43/04

[52] U.S. Cl. ..... 270/41; 493/342; 493/438; 493/446; 493/399

[58] Field of Search ..... 270/5, 41–42; 493/340, 342, 354–356, 360, 397, 399, 401–403, 436, 438, 443, 446

[56] References Cited

U.S. PATENT DOCUMENTS

| | | | |
|---|---|---|---|
| 1,625,862 | 4/1927 | Martin | 270/42 |
| 1,695,421 | 12/1928 | Gail | 403/397 |
| 3,125,335 | 3/1964 | Belker | 270/5 |
| 3,799,536 | 3/1974 | Gregoire | 493/342 |
| 3,819,172 | 6/1974 | Santaella | 270/41 |
| 4,378,223 | 3/1983 | Branecky et al. | 493/446 |
| 4,395,255 | 7/1983 | Branecky et al. | 493/446 |
| 4,490,132 | 12/1984 | Ogura | 270/42 |

FOREIGN PATENT DOCUMENTS

| | | | |
|---|---|---|---|
| 359607 | 9/1922 | Fed. Rep. of Germany | 493/438 |
| 151565 | 9/1982 | Japan | 493/446 |
| 729667 | 4/1980 | U.S.S.R. | 493/446 |

*Primary Examiner*—E. H. Eickholt
*Attorney, Agent, or Firm*—Spencer & Frank

[57] ABSTRACT

An apparatus for folding a running web has a deflecting roller supporting the running web; a scoring device for providing a weakening score line in the running web parallel to the running direction thereof for dividing the web into side-by-side arranged first and second web portions; and a folding roller supporting the running web and situated spaced from and downstream of the deflecting roller as viewed in the direction of web advance. The folding roller has a longitudinal axis oriented at least approximately at right angles to the longitudinal axis of the deflecting roller, whereby the running web undergoes an approximately 90° twist and the first web portion of the running web folds over the second web portion along the score line as the running web passes from the deflecting roller onto the folding roller. There are further provided a parallelling bar arranged in the immediate vicinity of the folding roller and cooperating therewith for pressing the running web thereagainst; and an adjusting mechanism for arbitrarily varying the relative position between the folding roller and the parallelling bar.

6 Claims, 4 Drawing Figures

APPARATUS FOR FOLDING A RUNNING WEB WITH FOLDING ROLLER AND ADJUSTABLE PARALLELLING BAR

BACKGROUND OF THE INVENTION

This invention relates to an apparatus for folding a running web such as a paper sheet carrying a printed recording thereon.

In the present day automation of plants and offices the problem is frequently encountered to provide appropriate machines for performing operations automatically on previously processed items. In case business forms (such as invoices or lists) which are printed-on conventionally by computer-controlled printers lengthwise on an A4 format or on paper of larger dimensions, and which are thereafter to be placed in envelopes of a C6/5 format, the individual sheets have been separated, folded twice transversely to the length of the severed paper sheet and in addition, cross-folded at right angles to the two transverse folds.

An automated cross-folding, however, has been involved with difficulties because either an additional folding apparatus with appropriate position-true advancing system or an expensive dual folding apparatus have been needed.

SUMMARY OF THE INVENTION

It is an object of the invention to provide an improved web folding apparatus which resolves the experienced difficulties in cross-folding and which, in particular, provides a fold in the web while it is advancing at high speed and before the web is transversely severed into individual sheets of determined dimensions.

This object and others to become apparent as the specification progresses, are accomplished by the invention, according to which, briefly stated, the apparatus for folding a running web has a deflecting roller supporting the running web; a scoring device for providing a weakening score line in the running web parallel to the running direction thereof for dividing the web into side-by-side arranged first and second web portions; and a folding roller supporting the running web and situated spaced from and downstream of the deflecting roller as viewed in the direction of web advance. The folding roller has a longitudinal axis oriented at least approximately at right angles to the longitudinal axis of the deflecting roller, whereby the running web undergoes an approximately 90° twist and the first web portion of the running web folds over the second web portion along the score line as the running web passes from the deflecting roller onto the folding roller. There are further provided a parallelling bar arranged in the immediate vicinity of the folding roller and cooperating therewith for pressing the running web thereagainst; and an adjusting mechanism for arbitrarily varying the relative position between the folding roller and the parallelling bar.

DESCRIPTION OF THE PREFERRED EMBODIMENT

Figure 1:
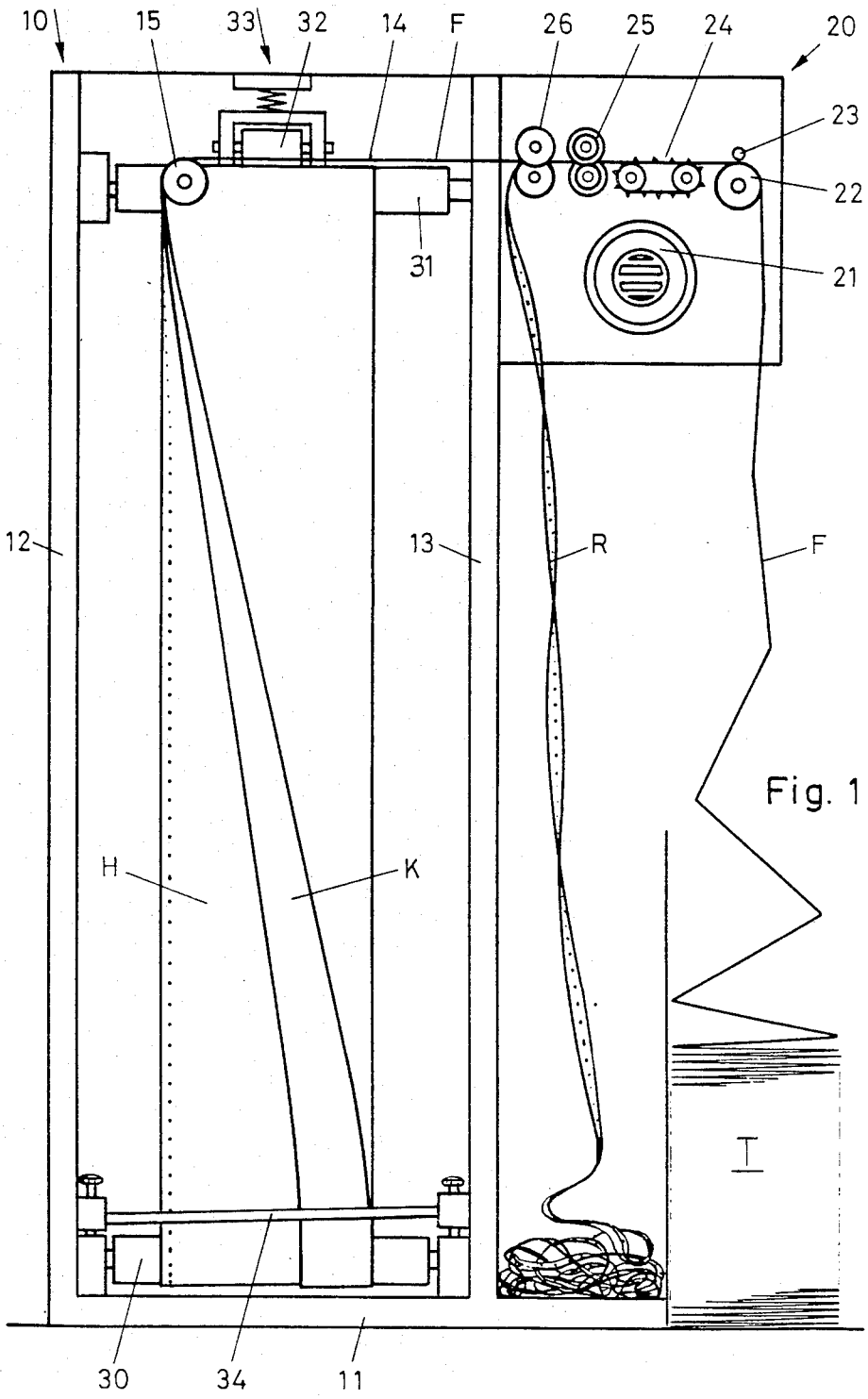
FIG. 1 is a schematic side elevational view of a preferred embodiment of the invention.
Figure 2:
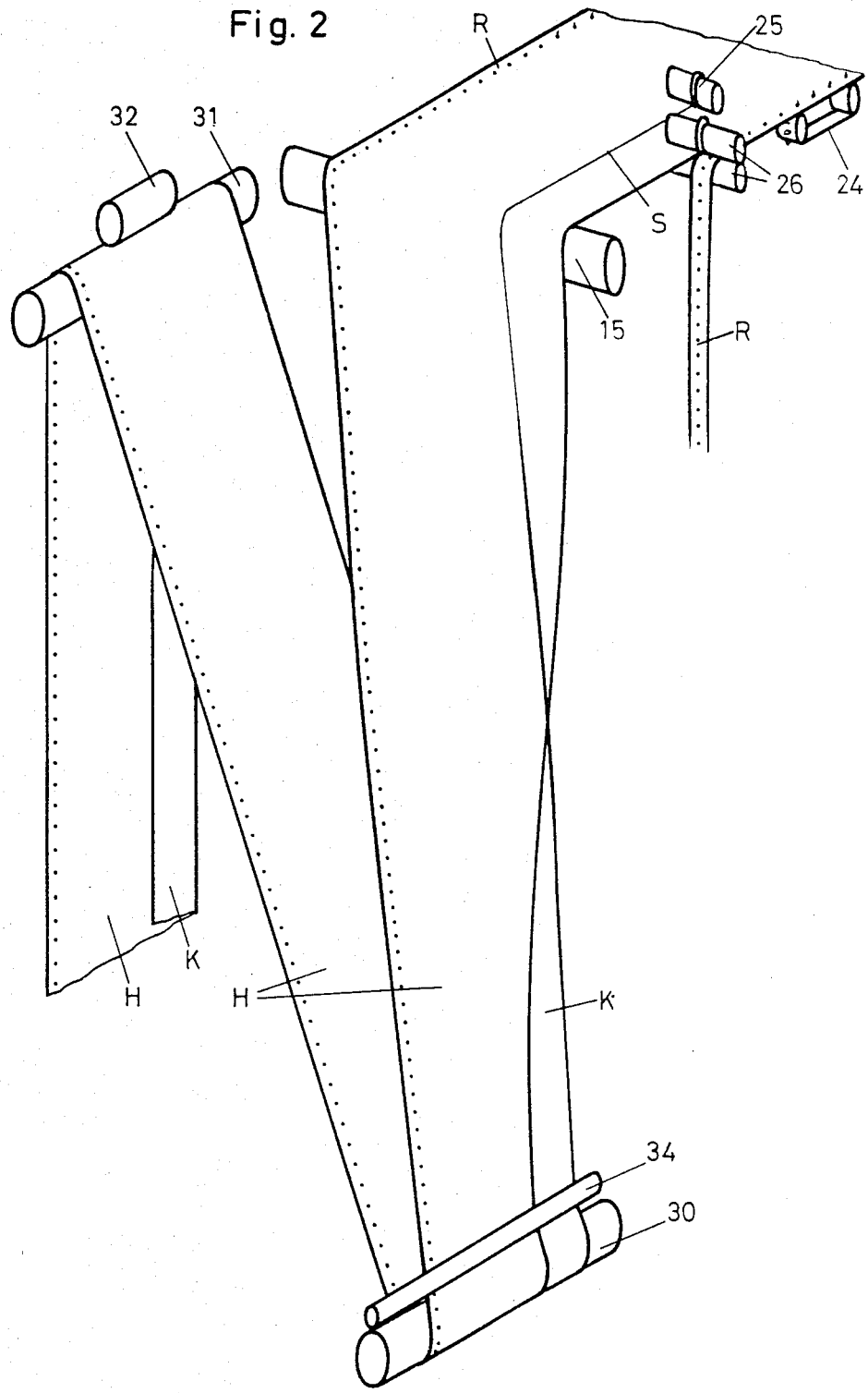
FIG. 2 is a schematic perspective view of the preferred embodiment.

Turning now to FIGS. 1 and 2, the web folding apparatus illustrated therein comprises a frame 10 having a base 11 and two upright carriers 12 and 13. In the upper part of the carriers 12 and 13 there are supported a conveyor table 14 and a deflecting roller 15 whose axis is oriented transversely to the running direction of a web (such as a continuous form) F. Externally of the frame 10 there are supported a drive 20 including a drive motor 21, a web inlet guide roller 22 associated with a hold-down device 23, a pair of sprocket belts 24 (only one shown) to engage into the bilateral remaligne perforations R, a scoring device 25 to provide a longitudinal weakening score line S into the web F parallel to its running direction upstream of the deflecting roller 15 and a cutter 26 for severing the perforated margin R on one side of the web, downstream of the scoring device 25.

The continuous form F is supported in an accordion-like folded state at T and is, by means of the sprocket belts 24 driven by the motor 21, pulled through between the inlet guide roller 22 and the hold-down roller 23 which cooperates with the roller 22. By means of the scoring device 25 which is, in a conventional manner, adjustable by shifting it along the width of the web F, a weakening score S is provided on the web F at the location where a web folding parallel to the running length is to be performed according to the invention. Thus, the score line S, prior to folding the web F therealong, divides the web F into side-by-side arranged web width. Downstream of the scoring device 25—as viewed in the direction of web advance—there is situated the cutter 26 which severs the perforated margin from that longitudinal web portion K which is to be folded over, along the score line S, onto the other web length portion H.

Downstream of the deflecting roller 15, at the bottom of the frame 10, there is supported a folding roller 30 whose axis is oriented generally perpendicularly to the axis of the deflecting roller 15. Thus, as the web F passes from the deflecting roller 15 to the folding roller 30, it undergoes a gradual 90° twist and also gradually, the length portion K folds over the web along the score line S.

Downstream of and parallel to the folding roller 30, at the top of the frame 10, there is supported a drawing roller 31 which is driven by the motor 21 and with which cooperates a pressing roller 32. A force exerting mechanism 33 causes the pressing roller 32 to be urged with a force against the drawing roller 31. The force is adjustable, whereby the tension of the web F may be varied in a simple manner.

Immediately above the folding roller 30 there is arranged a parallelling bar 34 whose purpose is to press the web F toward the folding roller 30 with a greater force at the folded-over portion K than in the principal (single-thickness) zone H. By virtue of the fact that the parallelling bar 34 is, as illustrated in FIG. 4, in the zone of the folded-over portion K situated above the folding roller 30, the loop angle of the web F about the folding roller 30 at that location is greater than in the zone of the principal web portion H.

It has been found that the difference of the wind round angle of the web F about the folding roller 30 along its length and thus the increase of the travelling path of the web F about the folding roller 30 along the length thereof has to be varied between wide limits dependent upon the nature (paper quality) of the web F in order to ensure a parallelism of the web F upstream amd downstream of the folding roller 30. For this purpose, on both sides of the parallelling bar 34 means are provided for the relative adjustment between the parallelling bar 34 and the folding roller 30.

Figure 3:
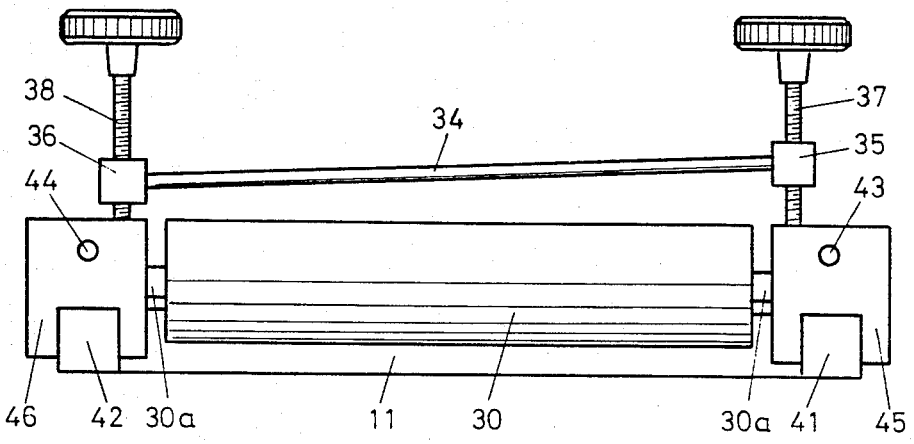
FIG. 3 is a side elevational view of components of the preferred embodiment on an enlarged scale relative to that of FIG. 1.
Figure 4:
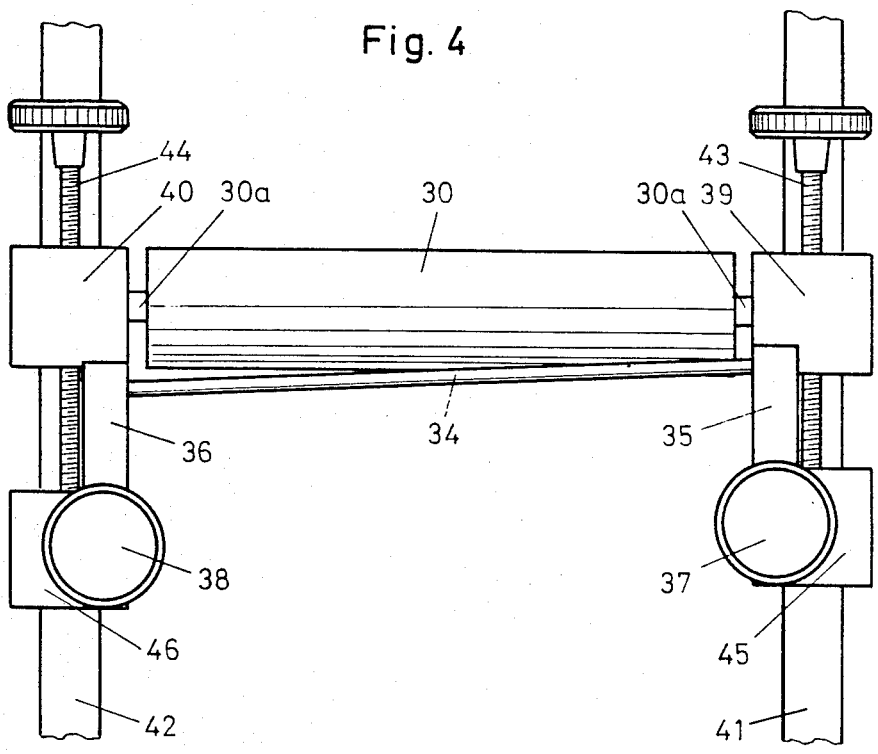
FIG. 4 is a top plan view of the structure shown in FIG. 3.

Accordingly, as illustrated in detail in FIGS. 3 and 4, the parallelling bar 34 is supported at both ends in guide carriers 35 and 36. Each guide carrier 35 and 36 is height adjustable by respective setscrews 37 and 38 which are rotatably supported in stationary holders 45 and 46 and which threadedly pass through the guide carriers 35, 36. Shiftable blocks 39 and 40 supported on lower frame bars 41 and 42, respectively, serve for supporting the two ends of the shaft 30*a* of the folding roller 30. The sliding blocks 39 and 40 are horizontally displaceable by setting screws 43 and 44 which are rotatably supported in holder 45 and 46 and which threadedly pass through the blocks 39, 40. By means of the four setting screws 37, 38, 43 and 44 the folding roller 30 and the parallelling bar 34 may be set into a desired position such that after a short run-in length of the web F, by rotating the setscrews 37, 38, 43 and 44 a relative position between the folding roller 30 and the parallelling bar 34 can be found which ensures a parallel guidance of the web F.

After the above-noted setting of the folding roller 30 and the parallelling bar 34 the web F may be drawn through the folding apparatus with a velocity selected to prevent material accumulation, without an undesired lateral shift of the web during run. It is noted that the risks of such a shift are particularly high in case—as described above—one of the two perforated margins R is removed. In case of such a shift the actual fold deviates from its correct desired position and thus the width of the web will vary and the longitudinal score line will be situated adjacent the fold.

It will be understood that the above description of the present invention is susceptible to various modifications, changes and adaptations, and the same are intended to be comprehended within the meaning and range of equivalents of the appended claims.

What is claimed is:

1. An apparatus for folding a running web having a direction of advance through the apparatus; comprising (a) a deflecting roller supporting the running web; said deflecting roller having a longitudinal axis;

(b) scoring means for providing a weakening score line in said running web parallel to the running direction thereof for dividing the web into side-by-side arranged first and second web portions;

(c) a folding roller supporting said running web; said folding roller being situated spaced from and downstream of said deflecting roller as viewed in said direction of advance; said folding roller having a longitudinal axis oriented at least approximately at right angles to the longitudinal axis of said deflecting roller, whereby said running web undergoes an approximately 90° twist and said first web portion of the running web folds over said second web portion along said score line as the running web passes from said deflecting roller onto said folding roller;

(d) a parallelling bar arranged in the immediate vicinity of said folding roller and cooperating therewith for pressing the running web thereagainst; and (e) adjusting means for arbitrarily varying the relative position between said folding roller and said parallelling bar for setting a desired wind round angle variation of said web about said folding roller along the longitudinal axis thereof.

2. An apparatus as defined in claim 1, wherein said first web portion has a perforated margin; further comprising cutting means situated upstream of said folding roller for severing said perforated margin from said first web portion.

3. An apparatus as defined in claim 1, wherein said adjusting means comprises means for altering a radial distance of said parallelling bar from said folding roller.

4. An apparatus as defined in claim 3, wherein said means for altering a radial distance comprises separate adjusting devices for shifting opposite ends of said parallelling bar independently from one another.

5. An apparatus as defined in claim 4, wherein the longitudinal axis of said folding roller is oriented horizontally and further wherein said adjusting means comprises means for horizontally shifting said folding roller.

6. An apparatus as defined in claim 5, wherein said means for horizontally shifting comprises separate adjusting devices for shifting opposite ends of said folding roller independently from one another.

* * * * *